US011648165B2

(12) United States Patent
Mahoney et al.

(10) Patent No.: US 11,648,165 B2
(45) Date of Patent: May 16, 2023

(54) PATIENT POSITIONING DEVICE

(71) Applicant: Anne Mahoney, Athens, GA (US)

(72) Inventors: Anne Mahoney, Athens, GA (US); Jeremy Smith, Athens, GA (US); Kyle Aasness, Athens, GA (US); Jeffrey Broadrick, Athens, GA (US)

(73) Assignee: Arthro-Positioning Systems LLC, Athens, GA (US)

( * ) Notice: Subject to any disclaimer, the term of this patent is extended or adjusted under 35 U.S.C. 154(b) by 135 days.

(21) Appl. No.: 17/209,982

(22) Filed: Mar. 23, 2021

(65) Prior Publication Data

US 2022/0062082 A1 Mar. 3, 2022

Related U.S. Application Data

(60) Provisional application No. 63/071,551, filed on Aug. 28, 2020.

(51) Int. Cl.

| | |
|---|---|
| ***A61G 13/00*** | (2006.01) |
| ***A61G 13/12*** | (2006.01) |
| ***A61G 13/10*** | (2006.01) |
| ***A63B 22/20*** | (2006.01) |
| ***A61H 1/02*** | (2006.01) |

(52) U.S. Cl.

CPC ..... *A61G 13/0063* (2016.11); *A61G 13/101* (2013.01); *A61G 13/12* (2013.01); *A61G 13/125* (2013.01); *A61G 13/126* (2013.01); *A61G 13/1245* (2013.01); *A61G 2200/327* (2013.01); *A61H 1/024* (2013.01); *A63B 22/203* (2013.01)

(58) Field of Classification Search

CPC ..... A61G 13/0063; A61G 13/126; A61G 2200/327; A61G 13/125; A61G 13/1245; A61G 7/1098; A61G 7/1096; A61G 7/075; A61G 7/0755; A61G 13/101; A61G 13/12; A61B 6/0421

See application file for complete search history.

(56) References Cited

U.S. PATENT DOCUMENTS 4,615,516 A * 10/1986 Stulberg ..... A61G 13/12 5/651
5,462,551 A * 10/1995 Bailey ..... A61B 90/50 606/88

(Continued)

OTHER PUBLICATIONS

Johnson, Jolie. "Does the Dumbbell Shape Make a Difference?" Healthy Living, Sep. 29, 2016, https://healthyliving.azcentral.com/dumbbell-shape-make-difference-20383.html. (Year: 2016).*

*Primary Examiner* — David R Hare
*Assistant Examiner* — Madison Emanski
(74) *Attorney, Agent, or Firm* — Smith Tempel Blaha LLC; Matthew T. Hoots

(57) ABSTRACT

Various embodiments, aspects and features of the present solution encompass a manually adjustable patient positioning device that is configured to reside on an operating table and outside the sterile field of a surgical environment. A carriage assembly rides along a pair of parallel guide rails and supports a cushioning device. A patient's foot, for example, may be placed on the cushioning device such that repositioning of the carriage assembly along the guide rails causes manipulation of the position and degree of articulation for the patient's knee during an orthopedic surgery.

12 Claims, 9 Drawing Sheets

(56) References Cited

U.S. PATENT DOCUMENTS

| | | | | |
|---|---|---|---|---|
| 6,826,794 | B2 | 12/2004 | Mahoney et al. | |
| 9,474,675 | B2 * | 10/2016 | Hansen | A61H 1/0244 |
| 10,357,236 | B2 * | 7/2019 | De Mayo | A61B 17/025 |
| 10,842,698 | B2 * | 11/2020 | Blackwell | A61G 13/1245 |

* cited by examiner

PATIENT POSITIONING DEVICE

CROSS-REFERENCE TO RELATED APPLICATIONS

This claims priority under 35 U.S.C. § 119(e) to U.S. provisional application entitled "PATIENT POSITIONING DEVICE," filed on Aug. 28, 2020 and assigned application Ser. No. 63/071,551, the entire contents of which are hereby incorporated by reference.

BACKGROUND

The present solution relates to surgical equipment and, more particularly, to a manually adjustable patient positioning device configured to be mounted to an operating table for use during orthopedic surgery.

A surgeon has need to manipulate the position and articulation of a patient's joint throughout an orthopedic surgery. Efficient and accurate manipulation of the joint, such as a knee, may not only reduce the duration of the surgery but also improve surgical results that lead to reduced patient recovery times. Consequently, various prior art solutions for manipulating a patient's joint during orthopedic surgery have come to market over the years.

Most of the prior art solutions are either electrically automated and/or cumbersome to actuate and/or must be used within the sterile field of the surgery. Electrically automated solutions, while usually very precise in joint positioning, are often complicated in their setup, require power supply access and cords (tripping hazard), and present opportunity for unintended manipulation of the patient's joint during surgery should the surgeon not be experienced with the electronic controls. Similarly, manual solutions known in the art are often cumbersome to use and inefficient for manipulating a patient's joint during surgery. And, patient positioning solutions that must be used within the sterile field of a surgery are generally not preferred by those of skill in the art because any instrument used with a sterile field of a surgery requires sterilization. As one of ordinary skill in the art would acknowledge, whenever possible in a surgical environment, it is desirable to use equipment configured to reside outside the sterile field of the surgery.

Therefore, there is a need in the art for a manually adjustable patient positioning device that is not only intuitive and efficient to use, but is also configured to reside and be used outside the sterile field of a surgical environment.

BRIEF SUMMARY

Various embodiments, aspects and features of the present solution encompass a manually adjustable patient positioning device that is configured to reside and be used outside the sterile field of a surgical environment. An exemplary embodiment is constructed from stainless steel and/or other materials suitable for sterilization.

Embodiments of a manually adjustable patient positioning device that is configured to reside and be used outside the sterile field of a surgical environment according to the solution are not limited to the exemplary aspects and features described herein. Certain embodiments may include additional features, or different features, while other embodiments include alternative features. As a way of example, and not limitation, it is envisioned that some embodiments of the solution may be configured to include a padded lateral support plate that is positionable to impede lateral movement of a patient's knee, for example.

An exemplary embodiment of a manually adjustable patient positioning device comprises a pair of parallel guide rails, at least one anchor rail associated with the pair of parallel guide rails, and a carriage assembly slidably mounted to the pair of parallel guide rails. The carriage assembly comprises a cushion component, at least one anchor component configured to releasably engage with the at least one anchor rail, and an anchor lever. Actuation of the anchor lever operates to release the at least one anchor component from engagement with the at least one anchor rail such that the carriage assembly is operable to be repositioned along the parallel guide rails. The carriage assembly is operable for repositioning in one direction along the parallel guide rails without user actuation of the anchor lever.

The at least one anchor rail may comprise a plurality of notches in some embodiments (similar to a picatinny rail) to define a discrete number of possible positions for the carriage assembly. In other embodiments, the at least one anchor rail may comprise a flat engagement surface with the at least one anchor component comprising a friction generating component for engaging the flat engagement surface. Such embodiments may essentially provide an infinite number of possible positions for the carriage assembly.

The exemplary manually adjustable patient positioning device may include bearings between the carriage assembly and the pair of parallel guide rails to ease repositioning of the carriage assembly along the guide rails. In some embodiments, the bearings may be dry running bearings. The parallel guide rails may be nonconductive. The cushion component may be releasably mounted in the carriage assembly, depending on embodiment, and may take any useful shape including, but not limited to, a cylinder or a "dumbbell" shape.

In the exemplary embodiment, the guide rails, anchor rails and carriage assembly may all be mounted atop a base plate. The base plate may include one or more mounting arms positioned vertically to the base plate (or guide rails) and configured to be received into table brackets that are operable to secure the one or more mounting arms to mounting rails on the side of an operating table. In this way, the entire patient positioning device may be placed on an operating table and releasably secured in place for the duration of a surgical event.

BRIEF DESCRIPTION OF THE DRAWINGS

In the drawings, like reference numerals refer to like parts throughout the various views unless otherwise indicated. For reference numerals with letter character designations such as "102A" or "102B", the letter character designations may differentiate two like parts or elements present in the same figure or different figures. Letter character designations for reference numerals may be omitted when it is intended that a reference numeral to encompass all parts having the same reference numeral in all figures.

DETAILED DESCRIPTION

Figure 1:
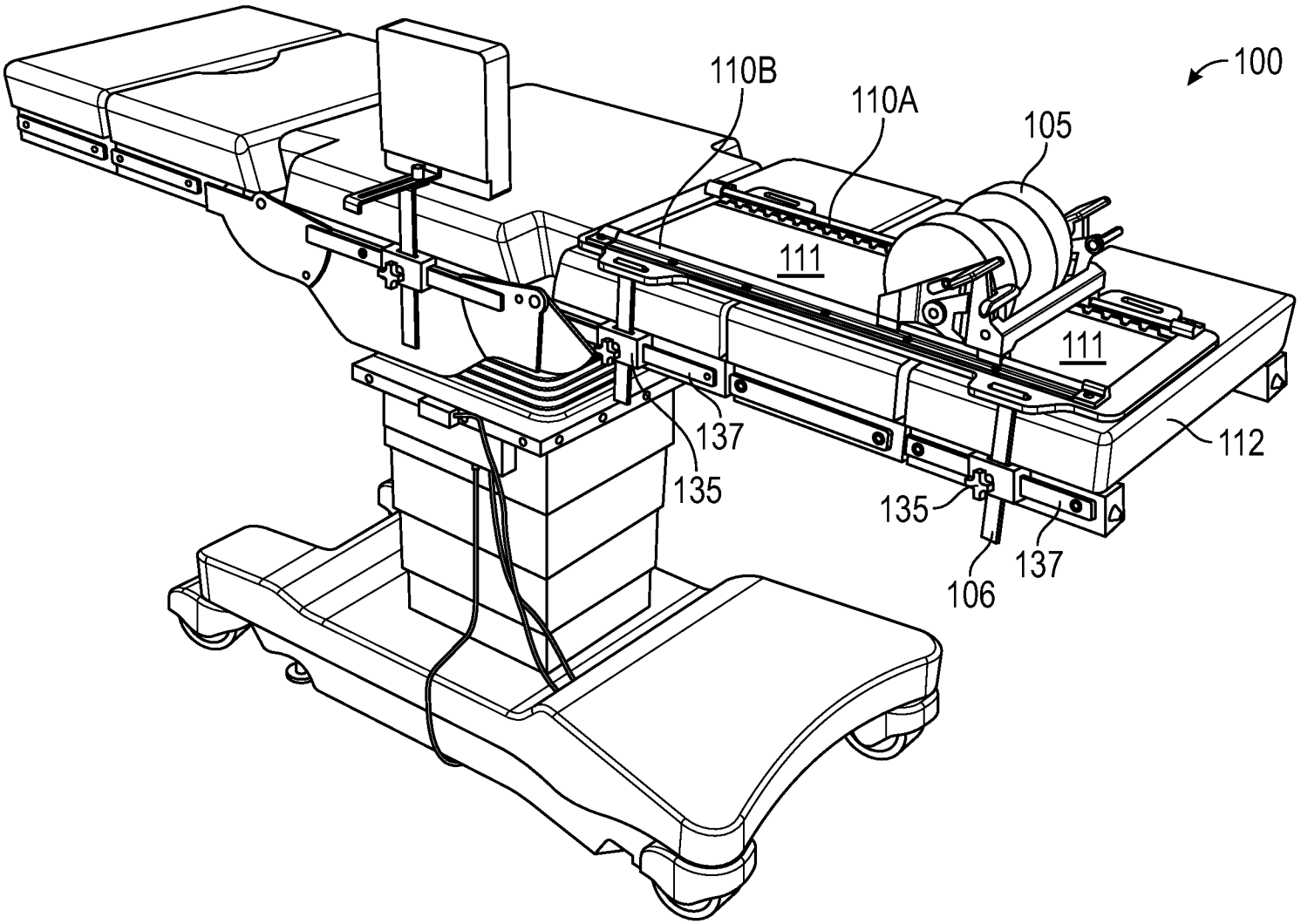
FIG. 1 is a perspective view of an exemplary embodiment of a patient positioning device according to the solution, shown mounted on an exemplary operating table.

Aspects, features and advantages of an exemplary embodiment of the present solution will become better understood with regard to the following description in connection with the accompanying drawing(s). It should be apparent to those skilled in the art that the described embodiment of the present solution provided herein is illustrative only and not limiting, having been presented by way of example only. All features disclosed in this description may be replaced by alternative features serving the same or similar purpose, unless expressly stated otherwise. Therefore, numerous other embodiments of the modifications thereof are contemplated as falling within the scope of the present solution as defined herein and equivalents thereto. Hence, use of absolute terms such as, for example, "will," "will not," "shall," "shall not," "must" and "must not," if used, are not meant to limit the scope of the present solution as the embodiment disclosed herein is merely exemplary.

The word "exemplary" is used herein to mean "serving as an example, instance, or illustration." Any aspect described herein as "exemplary" is not necessarily to be construed as exclusive, preferred or advantageous over other aspects.

In this description, an exemplary embodiment of the solution is shown and described within the context of an orthopedic knee replacement surgery. Beyond the general need to manipulate the position and angle of articulation of a patient's knee in such a surgery, it is unnecessary for the reader to understand further details of the surgical procedure itself in order to fully comprehend the nature and scope of the solution described in this specification and its accompanying drawings. Consequently, a full exposition of a typical orthopedic joint replacement surgery is not provided. Moreover, although the exemplary embodiment of the solution for a patient positioning device is shown and described within the context of a knee replacement surgery, it is envisioned that the exemplary embodiment, as well as variations thereof, may be used for other orthopedic surgeries such as, but not limited to, a hip replacement surgery, a ligament repair surgery, etc. and, as such, the scope of the solution is not limited in applicability to just knee replacement surgeries.

In this description, the terms "cushion component" and "footrest component" are essentially used interchangeably. Use of the more specific term "footrest component," as opposed to the more general term "cushion component" will not be interpreted to mean that embodiments of the solution might be limited in applicability to interacting with a patient's person via a foot. Rather, the term "footrest component" is used for the benefit of the reader so that a description of an exemplary embodiment of the solution within the context of an orthopedic knee surgery may be easily followed, since in such a surgery the user may manipulate a patient's knee via adjustment of the patient's foot position. It will be understood that embodiments of the solution may be used in any number of different orthopedic surgical applications and, in doing so, the "cushion component" may be leveraged to interface with a patient's person via positional adjustment of body parts other than a foot.

As will become clearer from the following description and the associated drawings, embodiments of the solution are advantageously configured to reside outside of the sterile field of a surgery. Such a configuration is advantageous over prior art solutions since sterilization may not be mandatory between uses of a patient positioning device according to the solution.

Generally, and as will be more thoroughly disclosed below, embodiments of a patient positioning device according to the solution are configured for manual actuation and so may not require an electrical or pneumatic or hydraulic power source. Embodiments may include a pair of parallel guide rails mounted to a chassis with a carriage assembly slidably and movably mounted to the guide rails. A disposable/removable cushion component may be included in the carriage assembly and configured for interfacing with a patient's person (such as by receiving a patient's foot). As the position of the carriage assembly is translated up and down the guide rails, so too is the cushion component such that the patient's limb is manipulated in position and/or degree of articulation. In some embodiments, the guide rails may be non-conductive.

FIG. 1 is a perspective view of an exemplary embodiment of a patient positioning device 100 according to the solution, shown mounted on an exemplary operating table 112. A pair of parallel, non-conductive guide rails 110A and 110B may be fixedly mounted to a base plate 111 configured to reside on a portion of the surface of an operating table 112 (usually near the foot of the operating table 112). In some embodiments, the guide rails 110 may be a part of a frame that does not include a base plate. The base plate 111 (or frame) may be fixed in position on top of the operating table 112 via table brackets 135 configured to mechanically engage mounting arms 106 with the mounting rails 137 that are along the side of operating table 112. As can be seen in the illustration, the mounting arms 106 extend perpendicularly downward from an edge of the base plate 111 (or frame). Notably, although the exemplary embodiment 100 is configured to be separably attached to, and removable from, the operating table 112, it is envisioned that some embodiments of the solution may be integrated into an operating table without departing from the scope of the solution. For embodiments of the solution that are integrated into an operating table, mounting arms 106 may not be required.

A cushion component 105 is mounted within a carriage. The particular cushion component 105 illustrated in the figures is in the form of a "dumbbell" and is particularly suited for receipt of a patient's foot. Other shapes for a cushion component 105 are envisioned. The carriage (will be shown and described in more detail in subsequent figures) is configured to mechanically engage with, and ride/slide along, guide rails 110 and may include dry running bearings, as would be understood by one of ordinary skill in the art of bearings. Advantageously, dry running bearings may not require additional lubricant inappropriate or inconvenient in a surgical environment.

Figure 2A:
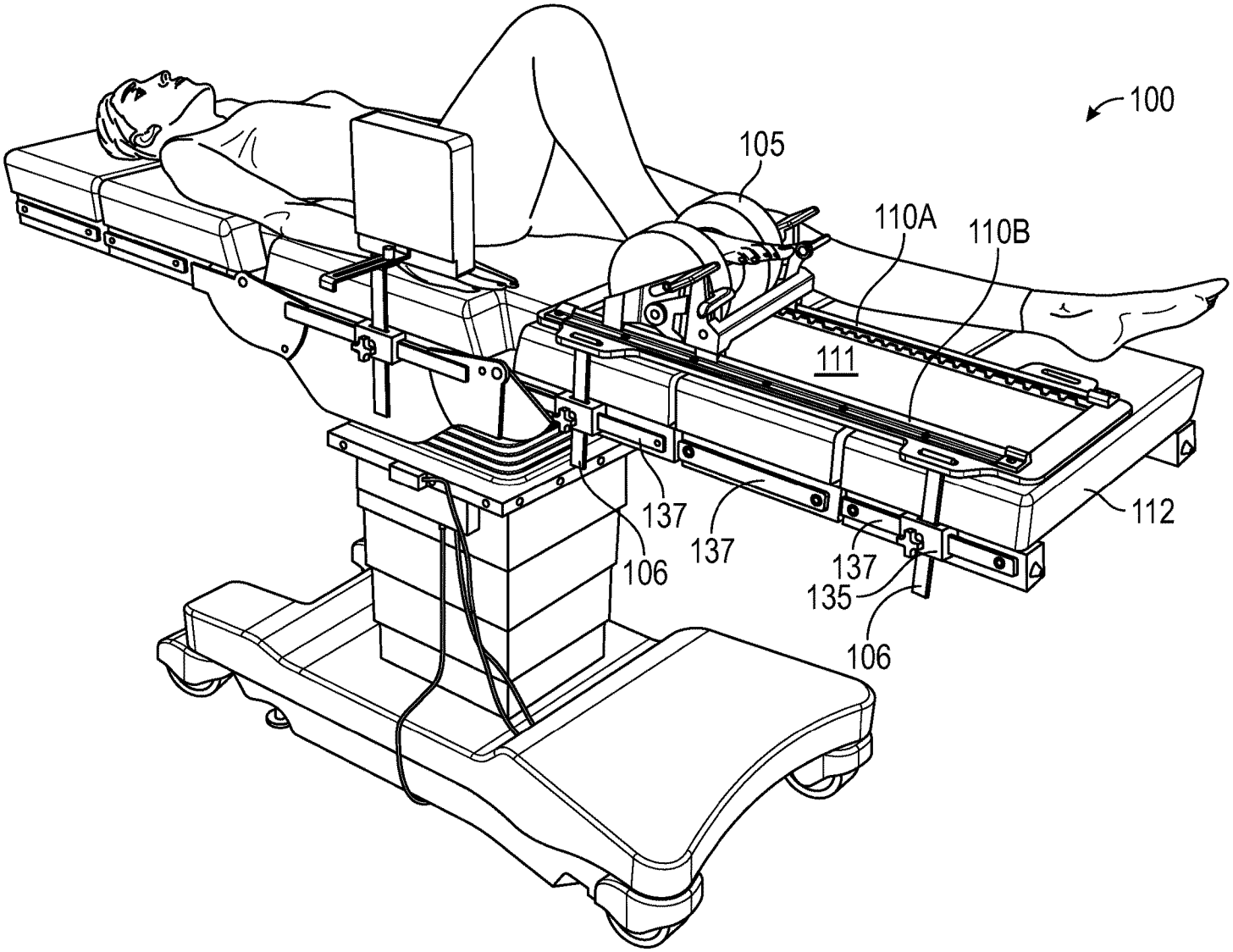
FIGS. 2A, 2B and 2C illustrate the exemplary embodiment of the patient positioning device solution of FIG. 1 being used to manipulate the position and articulation of a patient's knee joint.
Figure 2B:
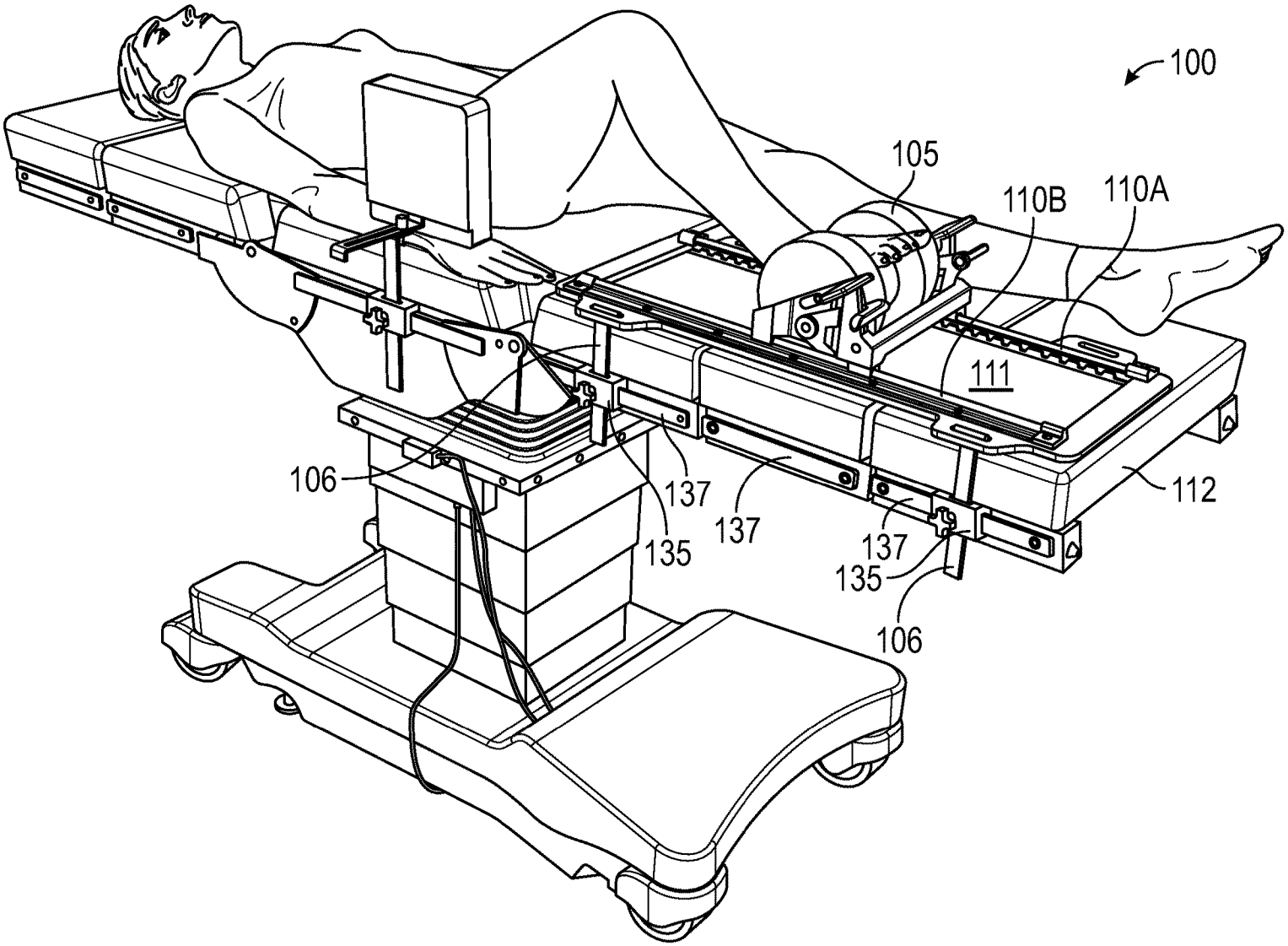
Figure 2C:
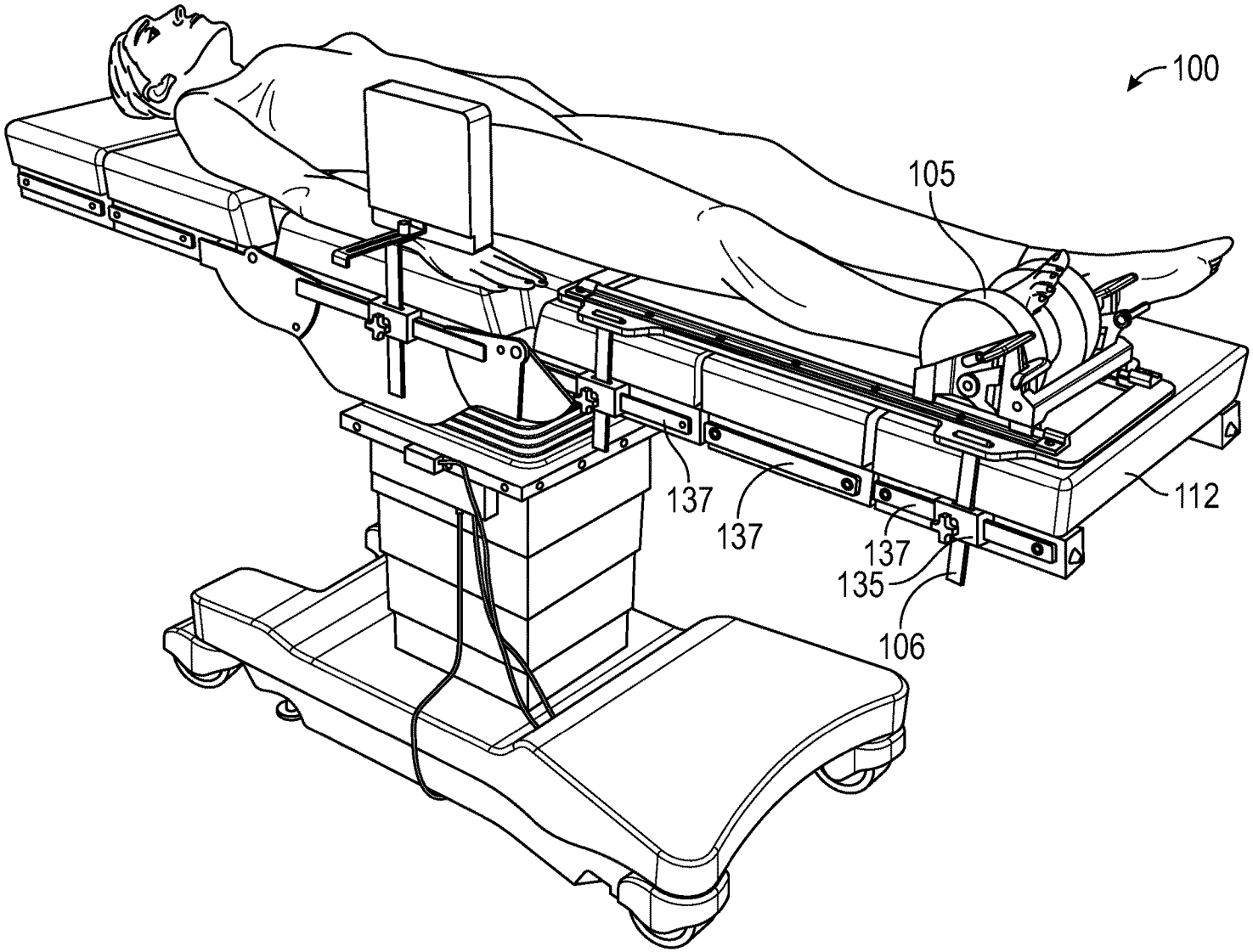

FIGS. 2A, 2B and 2C illustrate the exemplary embodiment 100 of the patient positioning device solution being used to manipulate the position and articulation of a patient's knee joint. Consistent with that which has been previously described, in operation the manually adjustable patient positioning device 100 that is configured to reside outside the sterile field of a surgical environment is mounted on an operating table such that the distal end of the guides 110 is toward the foot of the operating table 112. For a knee surgery, the foot of a patient residing on the operating table (the right foot of the patient in the illustration) may be placed in the footrest component 105 such that the knee is bent (as illustrated in FIG. 2A). Notably, it is an advantage of embodiments of the solution that mounting may be on either side of the operating table 112 without reversing the functional operation of the device. As shown in the illustrations, the device 100 is mounted on the right side of the operating table 112 in order to accommodate a surgery associated with the patient's right leg; however, the device 100 could have just as easily been mounted on the left side of the operating table 112 for a surgery associated with the patient's left leg. It is envisioned, however, that other embodiments of the solution may be configured specifically for use on one given side of an operating table, without the option to be used on an opposite side of the operating table, and so the scope of the solution is not limited to a patient positioning device that is universal in its function for use on either side of an operating table.

In the FIG. 2A illustration, the footrest component 105 has been positioned at or near the end of the device 100 most proximate to the patient and, in doing so, positions the patient's knee in a fully articulated or bent orientation. In FIG. 2B, the carriage and footrest component 105 has been repositioned at a midpoint of the guide rails 110 such that the patient's leg is partially extended and, correspondingly, the knee is partially articulated. In FIG. 2C, the carriage and footrest component 105 has been positioned at or near the end of the guide rails 110 most distal to the patient (near the end of the operating table 112) and, in doing so, allows the patient's leg to be fully extended and, correspondingly, the patient's knee in an orientation of minimal articulation.

Figure 3:
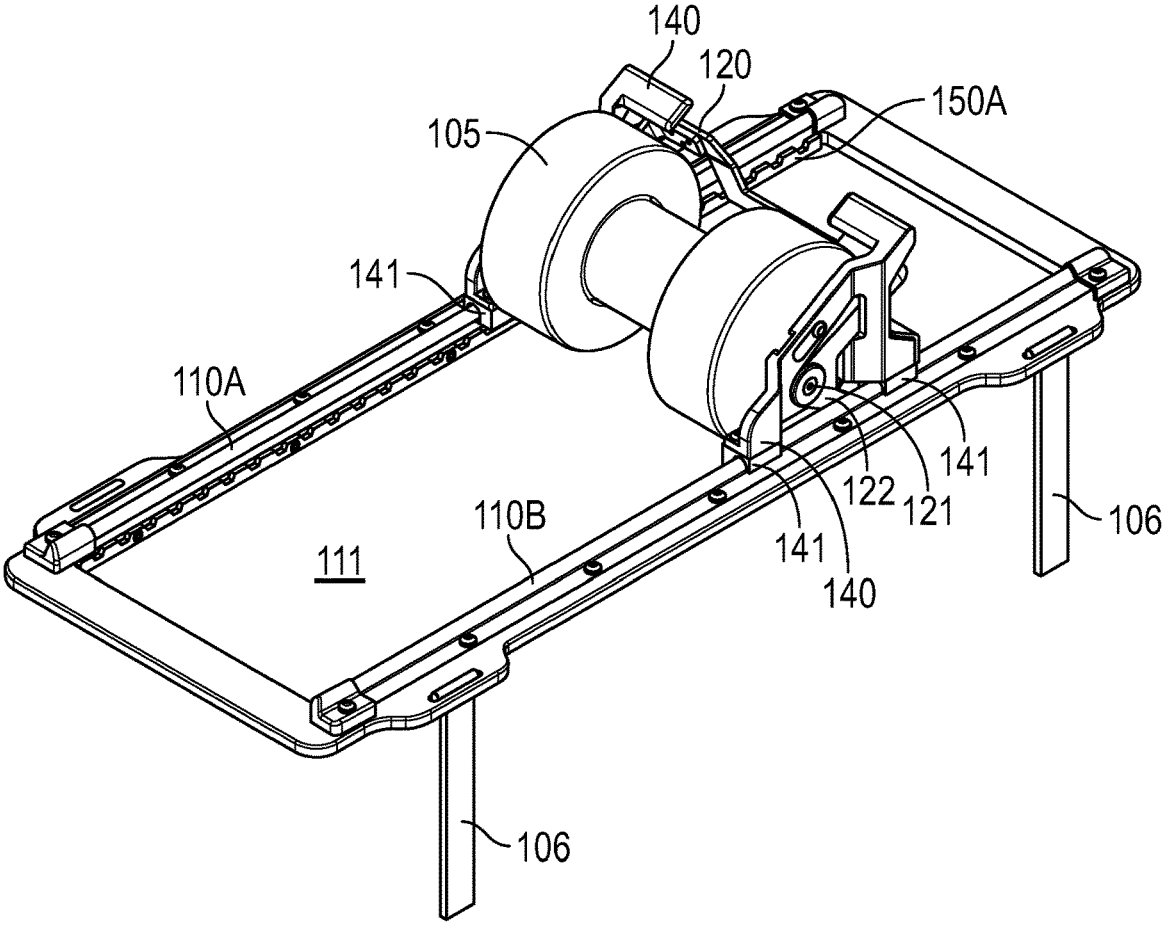
FIG. 3 is another perspective view of the exemplary embodiment of a patient positioning device shown in FIG. 1.
Figure 4:
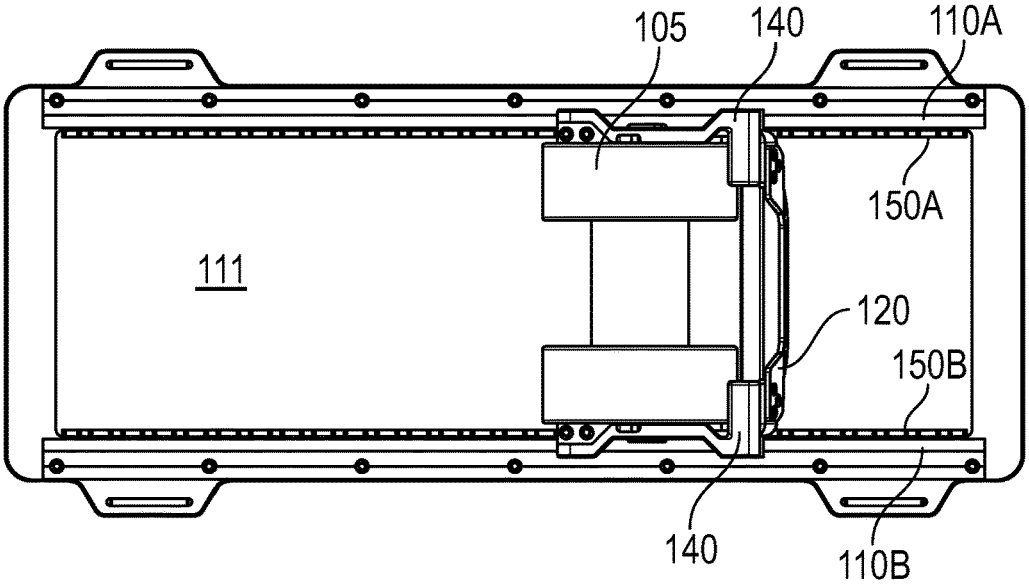
FIG. 4 is a top view of the exemplary embodiment of a patient positioning device shown in FIG. 1.
Figure 5:
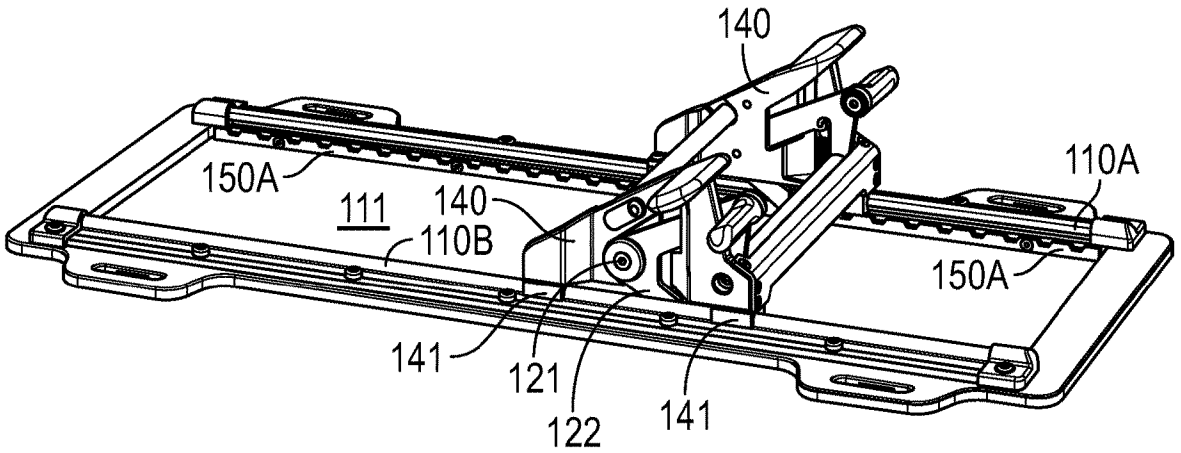
FIG. 5 is a top perspective view of the exemplary embodiment of a patient positioning device shown in FIG. 1, illustrated with the footrest component removed.
Figure 6:
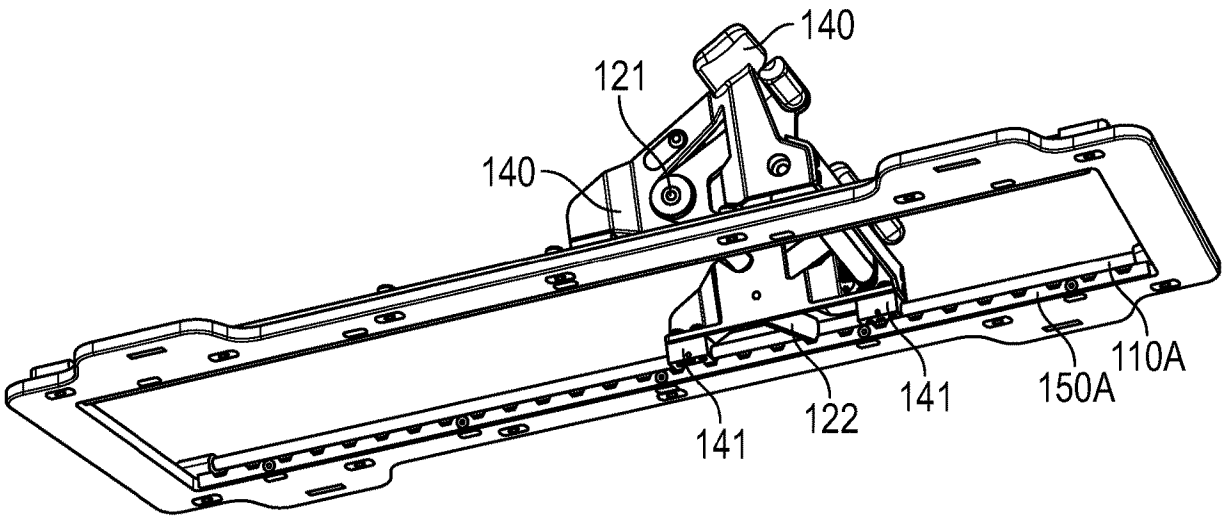
FIG. 6 is a bottom perspective view of the exemplary embodiment of a patient positioning device shown in FIG. 1, illustrated with the footrest component removed and a partial cutaway of the bottom baseplate.

Turning now to FIGS. 3, 4, 5 and 6, the illustrations will be simultaneously described. FIG. 3 is another perspective view of the exemplary embodiment of a patient positioning device shown in FIG. 1, FIG. 4 is a top view of the exemplary embodiment of a patient positioning device shown in FIG. 1, FIG. 5 is a top perspective view of the exemplary embodiment of a patient positioning device shown in FIG. 1 (illustrated with the footrest component removed), and FIG. 6 is a bottom perspective view of the exemplary embodiment of a patient positioning device shown in FIG. 1 (illustrated with the footrest component removed and a partial cutaway of the bottom baseplate).

Advantageously, the position of the footrest component 105 may be adjusted along guides 110 as described above, which works to adjust the relative degree that the patient's knee is bent. To translate the position of the carriage 140/footrest 105, thereby manipulating the patient's knee when the patient's foot resides on the footrest component 105, a user disengages anchors 122 from the anchor rails 150 and slides the carriage 140 to a new position. Once in the new position, the anchors 122 may be reengaged with the anchor rails 150, thereby securely fixing the carriage 140 and associated footrest 105 in position.

Figure 8B:
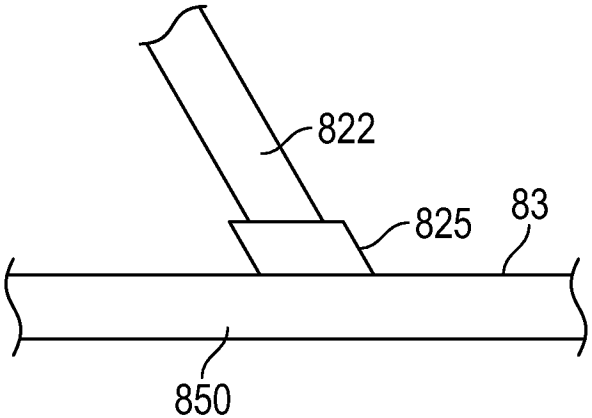
FIG. 8B is a closeup illustration of the engagement of an anchor along the engagement surface of an anchor rail, according to one exemplary embodiment of the solution that provides for infinite positioning of the carriage along the guide rails.
Figure 8A:
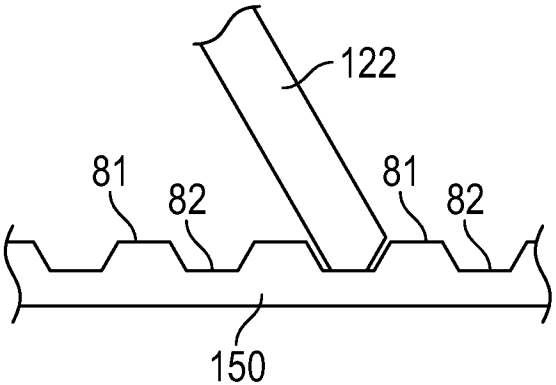
FIG. 8A is a closeup illustration of the engagement of an anchor in the notch of an anchor rail, according to one exemplary embodiment of the solution that provides for discrete positioning of the carriage along the guide rails.

In the exemplary embodiment shown in the figures, the anchor rails 150 include a series of notches that each define a position in which the carriage 140 may be locked via the anchors 122, as described above. The engagement of anchors 122 with a notch of anchor rails 150 may be best viewed in the FIG. 6 illustration (a detailed view will be shown and described relative to the FIGS. 8A and 8B illustrations). Looking through the cutaway portion of base plate 111 in the FIG. 6 illustration, it can be seen that left-side anchor 122 is engaged in a notch of left-side anchor rail 150A. Although not seen in the FIG. 6 illustration, one of ordinary skill in the art reviewing the figures and contemplating this description will understand that a complementary right-side anchor is engaged with a complementary notch of right-side anchor rail 150B, thereby coordinating with the left-side anchor to fix the carriage 140 in a position.

The carriage 140 may be mechanically locked in a position relative to guide rails 110 via anchors 122 that are configured to be received by notches in anchor rails 150. As can be seen in the illustrations, anchor rails 150 are positioned along and below guide rails 110. In the exemplary embodiment, anchor rails 150 are separate components from guide rails 110, although it is envisioned that in some embodiments anchor rails 150 and guide rails 110 may be integral. When the anchors 122 are engaged with a notch(es) of anchor rails 150, the carriage 140 may be fixed/locked in position. A user may disengage anchors 122 from notch(es) of the anchor rails 150 by actuating anchor lever 120. Anchor lever 120 is rotatably hinged to the carriage 140 at hinge point 121 and, therefore, actuation of anchor lever 120 may cause anchors 122 to "lift" and disengage from notches on anchor rails 150. Advantageously, with anchors 122 disengaged, the carriage 140 may be free to reposition anywhere along the guide rails 110.

Notably, the anchor 122 engages the notch of anchor rail 150A at an angle toward the distal end of the device 100 (i.e., toward the foot of operating table 112—see illustrations in FIGS. 1-2). In this way, a force applied to the carriage via the weight of a patient's foot/leg on the footrest component 105 (see FIG. 2) will urge the anchor(s) 122 into the given notches of anchor rails 150 into which they are engaged. Advantageously, however, an opposing force applied to the carriage 140 (i.e., a force applied in opposite direction to the force exerted on carriage 140 via a patient's foot), such as by a surgeon pushing on the carriage in the direction of the patient (see FIG. 2), will allow the carriage 140 to be moved to a different position along anchor rails 150 in the direction of the patient as the anchors 122 "click" or slide over the flats of the anchor rails 150 into different notch pairs. Moving the carriage 140 to a different position along rails 150 in a direction toward the distal end of the operating table (i.e., in the direction of the force applied by the weight of the patient's foot/leg) may require the user to apply a disengaging force toward the patient such that the anchors 122 are disengaged from their respective notches before anchor lever 120 is actuated. As will be described more thoroughly below, when the anchor lever 120 is actuated upward by a user the anchors 122 may be held above the anchor rails 150 such that the carriage 140 may be moved to a position distal to the patient. The user releasing the anchor lever 120 may cause the anchors 122 to securely engage with the nearest notches on the anchor rails 150.

Figure 7A:
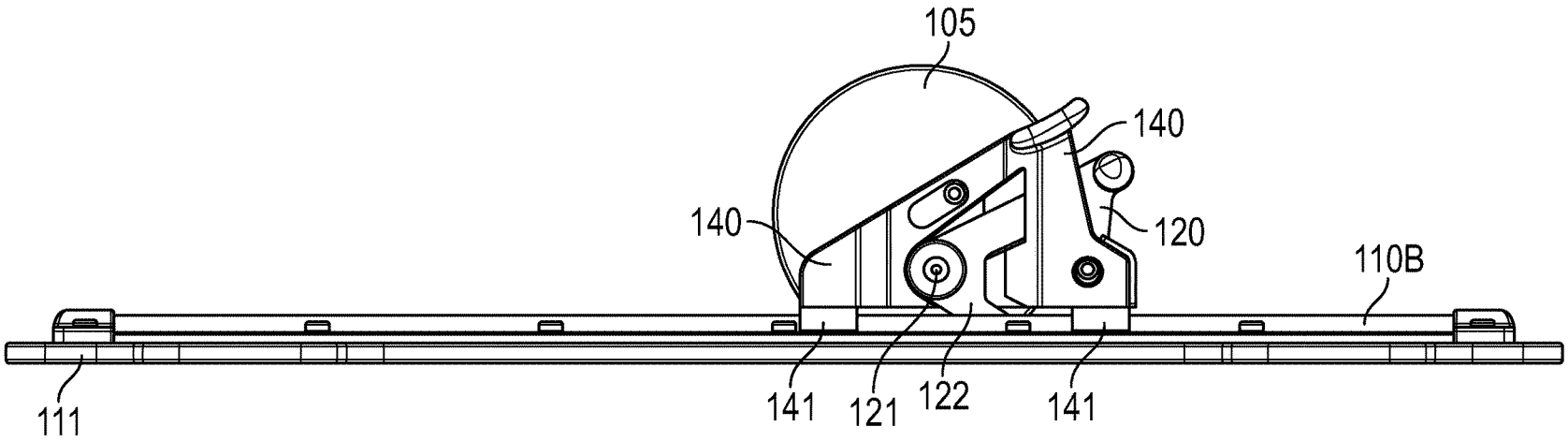
FIGS. 7A and 7B are side views of the exemplary embodiment of a patient positioning device shown in FIG. 1, illustrating actuation of the device in order to manipulate the position and articulation of a patient's joint.
Figure 7B:
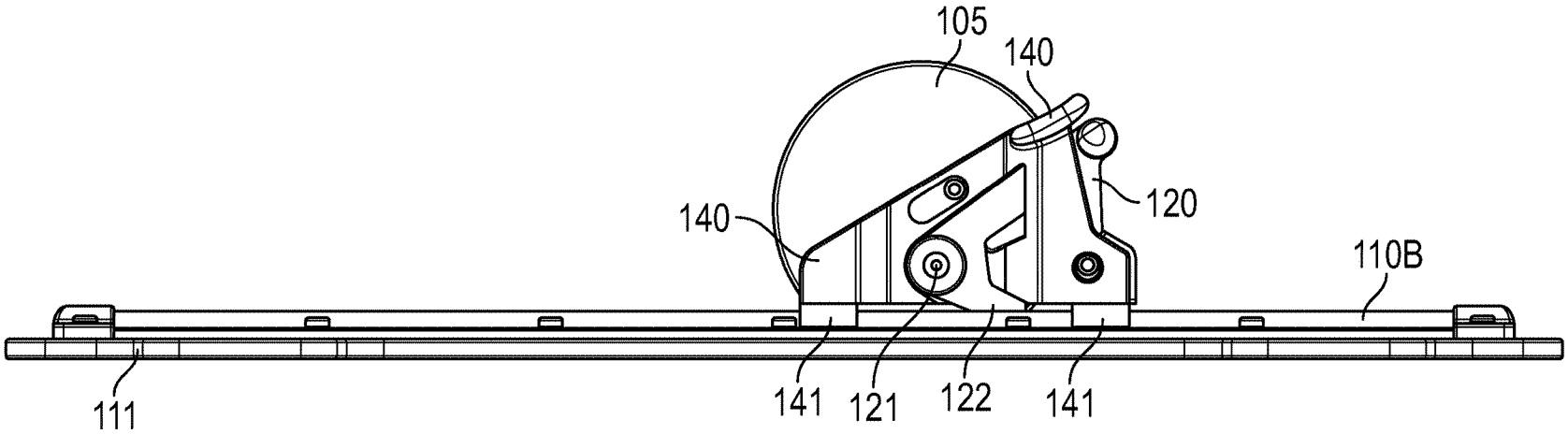

FIGS. 7A and 7B are side views of the exemplary embodiment of a patient positioning device 100 shown in FIG. 1, illustrating actuation of the device in order to manipulate the position and articulation of a patient's joint. As previously explained, when in use, the patient's foot may be placed on the footrest component 105 which, in turn, applies a force in a direction away from the patient (i.e., distal to the patient and toward the distal end of the operating table 112). The force exerted by the weight of the patient's foot/leg may be thought of as an engaging force that urges the anchors 122 into a given notch of the anchor rails 150, as previously described. For a user (i.e., a surgeon) to manipulate the position and/or degree of articulation of the patient's knee, the user must actuate the device 100 to move the carriage 140 either toward the patient or away from the patient.

In the FIG. 7A illustration, the carriage 140 is stationary and engaged in a given position. The anchors 122 are in a lowered position and mechanically engaged with a given notch(es) of the anchor rails 150 (as best seen in the FIG. 6 illustration). From the position shown in the FIG. 7A illustration, movement of the carriage 140 toward the patient may only require application of a force that opposes, and overcomes, the engaging force exerted by the patient's foot. As previously described, such an opposing force may cause the anchors 122 to "click" over into notches of the anchor rails 150 toward the patient.

In the FIG. 7B illustration, the anchor lever 120 has been actuated such that the anchors 122 will have been disengaged from their respective notches on the anchor rails. As can be seen and understood in the FIG. 7B illustration, the anchor lever 120 has been actuated toward the upper handle portion of carriage 140 (such as by a user "squeezing" the anchor lever 120 toward the carriage 140). In doing so, the arms of anchor lever 120 pivot around point 121, thereby causing anchors 122 to disengage from the notches of rails 150, as previously described. A slight disengaging force that opposes the engaging force exerted from the weight of the patient's foot may be applied to the carriage to ease the anchors out of engagement with the notches of the anchor rails before the anchor lever 120 is fully actuated to raise the anchors 122 above the anchor rails 150. Once the anchor lever is fully actuated, the carriage 140 may be easily repositioned in either direction along the guide rails 110A, 110B and anchor rails 150. Advantageously, the carriage 140 may include bearings 141 to support its smooth movement along the guide rails 110. The bearings 141 may be dry running bearings in some embodiments of the solution, as dry running bearings may not require additional lubricant inappropriate or inconvenient in a surgical environment. Once in a new position, the anchor lever 120 may be allowed to return to a pre-actuation state, thereby allowing the anchors 122 to reengage with the anchor rails 150 and securely fix the carriage 140 in position. With the carriage 140 securely fixed in a given position, the position of a patient's knee may be held in place.

As illustrated in the figures, the exemplary embodiment of the solution for a patient positioning device is configured to translate the position of the carriage 140 (and, by extension, the position a patient's limb) to any of a number of discrete positions defined by the notches of the anchor rails 150. It is envisioned, however, that other embodiments of the solution may essentially offer an infinite position adjustment of the carriage 140. In such embodiments, the anchor rails may not include a series of notches but, rather, provide a consistent and substantially flat positioning surface.

Turning now to the FIGS. 8A and 8B illustrations, detailed views of the discrete adjustment arrangement (as has been described above in relation to the exemplary embodiment of the solution illustrated in FIGS. 1-7) and the envisioned infinite adjustment arrangement are provided. FIG. 8A is a closeup illustration of the engagement of an anchor 122 in the notch 82 of an anchor rail 150, according to one exemplary embodiment of the solution that provides for discrete positioning of the carriage along the guide rails. The 8A illustration is consistent with that which has been shown and described above in relation to FIGS. 1-7. By contrast, FIG. 8B is a closeup illustration of the engagement of an anchor 822 along the engagement surface 83 of an anchor rail 850, according to one exemplary embodiment of the solution that provides for infinite positioning of the carriage along the guide rails.

Referring to the FIG. 8B illustration, the anchor 822 may include a friction generating component 825 comprised of, for example, a rubber or some other material useful for generating a coefficient of friction between the anchor 822 and the anchor rail 850. Similar to that which has been previously described relative to the previous figures, an engaging force applied to the footrest component/carriage by the weight of a patient's foot will cause the anchor 822 to urge onto the engagement surface 83 of the anchor rail 850. In turn, the friction generating component 825 may prevent the anchor 822 from "slipping" down anchor rail 850, thereby keeping the carriage securely in position. A slight disengaging force applied by a user in opposition to the engaging force of the patient's foot will allow the anchor lever 120 to be actuated such that the anchor 822 is lifted away from the engagement surface 83 of the anchor rail 850. Consistent with that which has been previously described, once the anchor 822 is fully disengaged from the anchor rail 850, the carriage 140 may be moved to a different position along the guide rails. Release of the anchor lever 120 will allow the anchor 822 to reengage the anchor rail 850 at the new position.

Figure 9A:
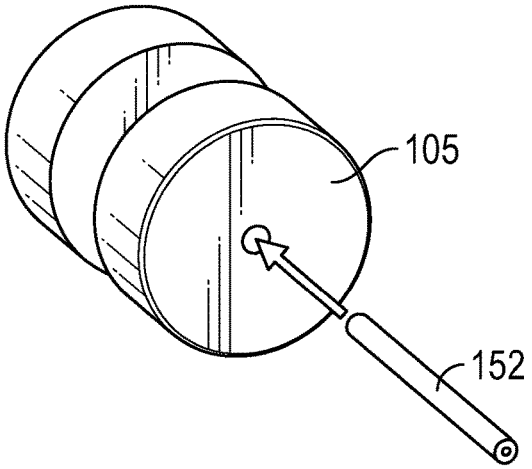
FIGS. 9A and 9B illustrate the removal and replacement of the footrest component for the exemplary embodiment of a patient positioning device shown in FIG. 1.
Figure 9B:
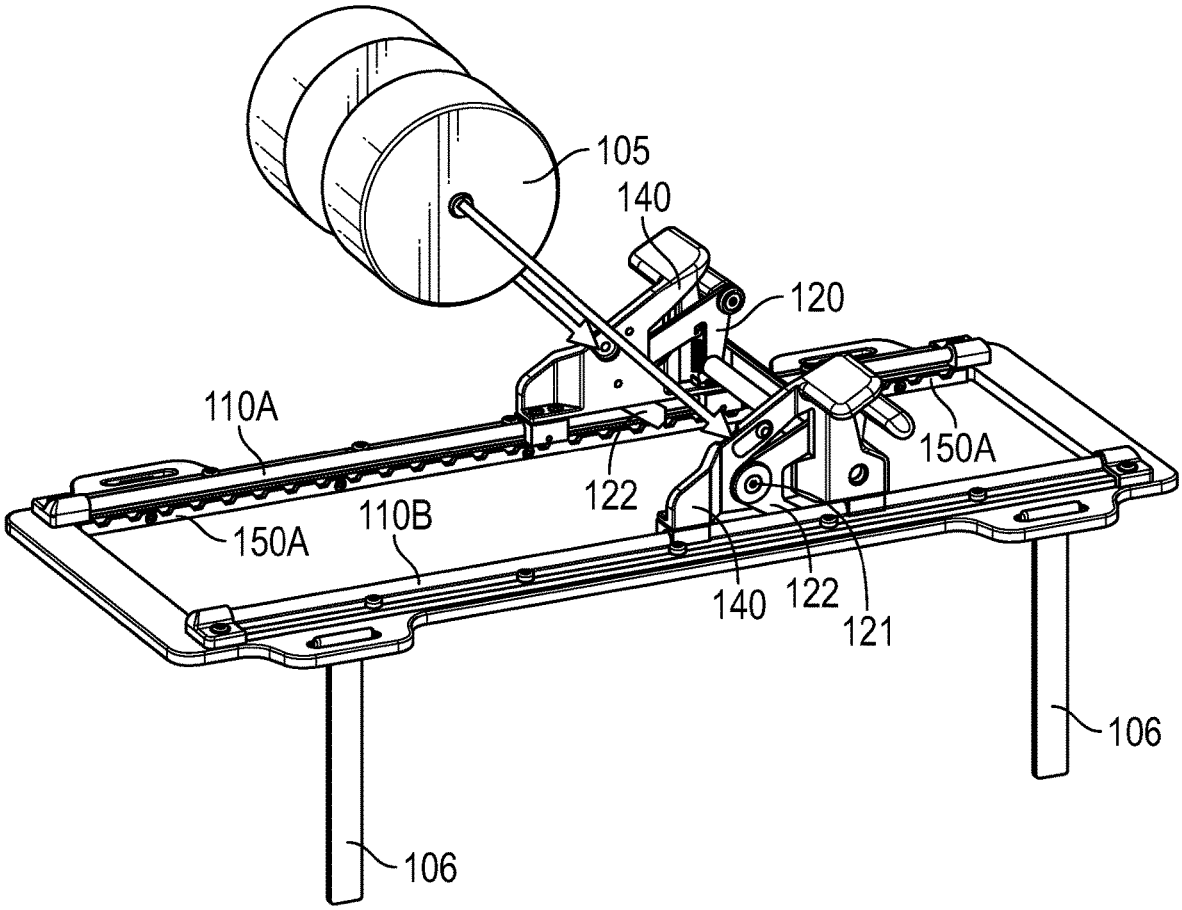

FIGS. 9A and 9B illustrate the removal and replacement of the cushion component 105 for the exemplary embodiment of a patient positioning device shown in FIG. 1. Advantageously, it is envisioned that embodiments of the solution may be configured for easy replacement of the cushion component 105 such that a new cushion component 105 may be installed for a given surgical event. That is, the cushion component 105 may be disposable in some embodiments. It is also an advantage of some embodiments of the solution that all components may be either disposable or easily sterilized (if required).

As can be understood from the FIGS. 9A and 9B illustrations, the cushion component 105 may be configured for receipt of a supporting rod 152 that extends through the cushion component 105. The supporting rod 152 may be releasably received into the carriage 140. Once received into the carriage 140, the supporting rod 152 supports the cushion component 105. Removal of the supporting rod 152 from the carriage 140 allows for easy replacement of the cushion component 105.

Systems, devices and methods for a patient positioning device have been described using detailed descriptions of embodiments thereof that are provided by way of example and are not intended to limit the scope of the disclosure. The described embodiments comprise different features, not all of which are required in all embodiments of a patient positioning device. Some embodiments of a patient positioning device utilize only some of the features or possible combinations of the features. Variations of embodiments of a patient positioning device that are described and embodiments of a patient positioning device comprising different combinations of features noted in the described embodiments will occur to persons of the art.

It will be appreciated by persons skilled in the art that systems, devices and methods for the provision of a patient positioning device is not limited by what has been particularly shown and described herein above. Rather, the scope of systems, devices and methods for the provision of a patient positioning device is defined by the claims that follow.

What is claimed is:

1. A manually adjustable patient positioning device, comprising: a pair of parallel guide rails; at least one anchor rail directly coupled beneath the pair of parallel guide rails; and a carriage assembly slidably mounted to the pair of parallel guide rails such that it is operable to be positioned along the parallel guide rails, wherein the carriage assembly comprises: a cushion component; at least one anchor component configured to releasably engage with the at least one anchor rail; and an anchor lever; wherein, when the at least one anchor component is engaged with the at least one anchor rail, the carriage assembly is fixed in a first position along the parallel guide rails; and wherein, when the at least one anchor component is disengaged from the at least one anchor rail by actuation of the anchor lever, the carriage assembly is operable to be slidably repositioned to a second position along the parallel guide rails.

2. The manually adjustable patient positioning device of claim 1, wherein the at least one anchor rail comprises a plurality of notches.

3. The manually adjustable patient positioning device of claim 1, wherein the at least one anchor rail comprises a flat engagement surface and the at least one anchor component comprises a friction generating component.

4. The manually adjustable patient positioning device of claim 1, further comprising bearings between the carriage assembly and the pair of parallel guide rails.

5. The manually adjustable patient positioning device of claim 4, wherein the bearings are dry running bearings.

6. The manually adjustable patient positioning device of claim 1, wherein the parallel guide rails are nonconductive.

7. The manually adjustable patient positioning device of claim 1, wherein the cushion component is releasably mounted in the carriage assembly.

8. The manually adjustable patient positioning device of claim 1, wherein the cushion component is cylindrical.

9. The manually adjustable patient positioning device of claim 1, wherein the cushion component is in the shape of a dumbbell.

10. The manually adjustable patient positioning device of claim 1, further comprising a base plate.

11. The manually adjustable patient positioning device of claim 1, further comprising one or more mounting arms positioned vertically to the guide rails and configured to be received into table brackets operable to secure the one or more mounting arms to mounting rails on the side of an operating table.

12. The manually adjustable patient positioning device of claim 1, wherein the carriage assembly is operable for repositioning in one direction along the parallel guide rails without user actuation of the anchor lever.

* * * * *